US008029069B2

(12) United States Patent
Kwon et al.

(10) Patent No.: US 8,029,069 B2
(45) **Date of Patent: *Oct. 4, 2011**

(54) METHOD OF MANUFACTURING TOOTHBRUSH WITH NEEDLE-SHAPED BRISTLES, AND TOOTHBRUSH MANUFACTURED BY THE SAME

(76) Inventors: Young-Jun Kwon, Gyunggi-do (KR); Sung-Wook Kwon, Seoul (KR); Sung-Hwan Kwon, Seoul (KR)

( * ) Notice: Subject to any disclaimer, the term of this patent is extended or adjusted under 35 U.S.C. 154(b) by 1029 days.

This patent is subject to a terminal disclaimer.

(21) Appl. No.: 11/817,496

(22) PCT Filed: Apr. 19, 2005

(86) PCT No.: PCT/KR2005/001115

§ 371 (c)(1),
(2), (4) Date: Oct. 4, 2007

(87) PCT Pub. No.: WO2006/107123

PCT Pub. Date: Oct. 12, 2006

(65) Prior Publication Data

US 2008/0100126 A1 May 1, 2008

(30) Foreign Application Priority Data

Apr. 8, 2005 (KR) ..... 10-2005-0029336

(51) Int. Cl.
*A46D 9/00* (2006.01)

(52) U.S. Cl. ..... 300/21; 15/207.2; 15/167.1; 300/2

(58) Field of Classification Search ..... 15/207.2; 300/21; 428/399, 401
See application file for complete search history.

(56) References Cited

U.S. PATENT DOCUMENTS

| | | | | |
|---|---|---|---|---|
| 2,567,080 | A * | 9/1951 | Pifer | 15/167.1 |
| 4,475,261 | A * | 10/1984 | Okumura et al. | 15/195 |
| 5,165,761 | A | 11/1992 | Dirksing | |
| 5,500,975 | A * | 3/1996 | Sano | 15/167.1 |
| 6,764,142 | B2 | 7/2004 | Kwon | |
| 7,832,811 | B2 * | 11/2010 | Kwon et al. | 300/21 |
| 2004/0070258 | A1 * | 4/2004 | Kwon | 300/21 |

FOREIGN PATENT DOCUMENTS

| | | |
|---|---|---|
| JP | 2000-14447 | 1/2000 |
| JP | 2002-330824 | 11/2002 |
| JP | 2002330824 A * | 11/2002 |

* cited by examiner

*Primary Examiner* — Monica S Carter
*Assistant Examiner* — Stephanie Newton
(74) *Attorney, Agent, or Firm* — Egbert Law Offices PLLC

(57) ABSTRACT

The present invention provides a method of manufacturing a toothbrush having needle-shaped bristles, and a toothbrush manufactured by the method. The toothbrush manufacturing method of the present invention includes the step of partially tapering ends of bristles, which are made of polyester and are set in a toothbrush body, through a physical grinding process, and the step of completing of a process of tapering the partially tapered bristles by immersing the partially tapered bristles in a chemical. The present invention makes it possible for toothbrush bristles to be tapered through a simple process. Furthermore, the present invention solves conventional difficulties occurring in tapering bristles after setting them in toothbrush bodies.

6 Claims, 2 Drawing Sheets

[Fig. 1]
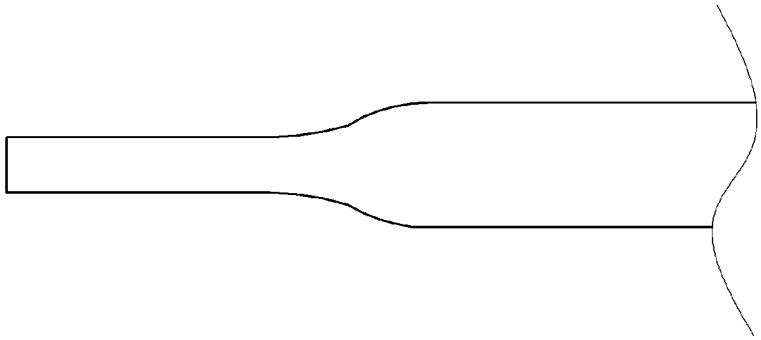
[Fig. 2]
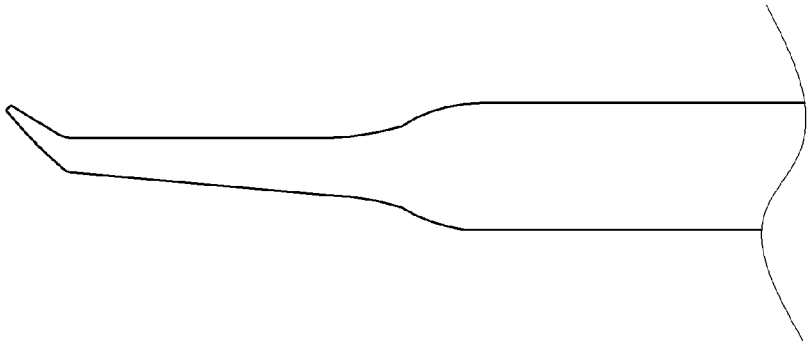
[Fig. 3]
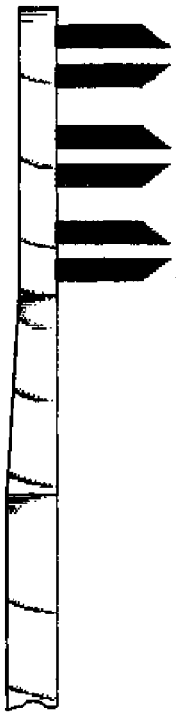

[Fig. 4]
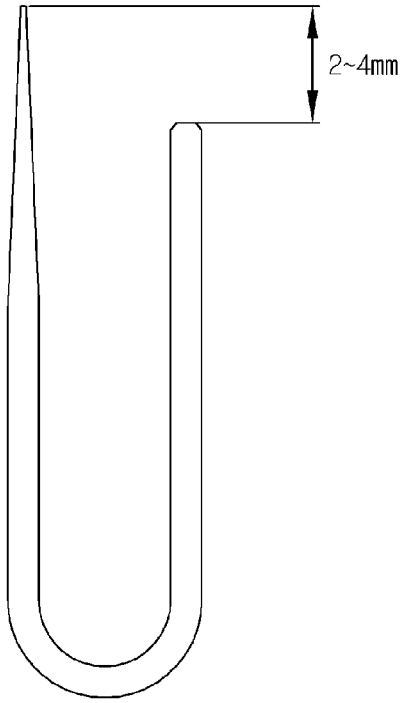
[Fig. 5]
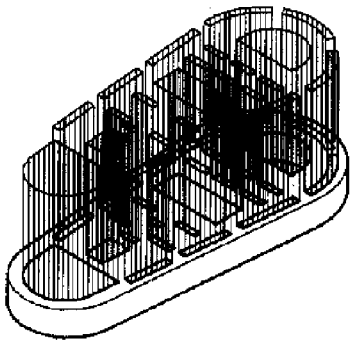
[Fig. 6]
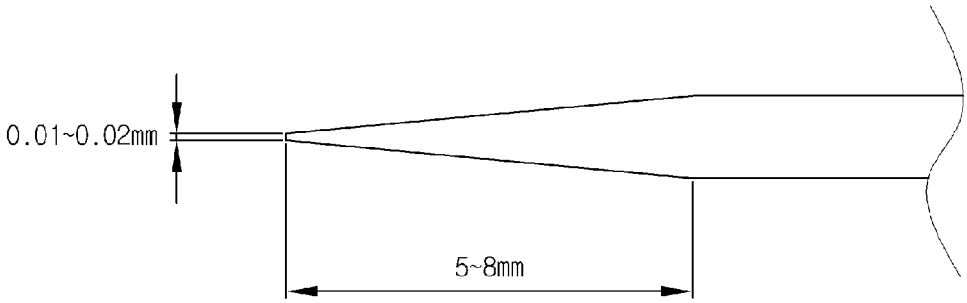

METHOD OF MANUFACTURING TOOTHBRUSH WITH NEEDLE-SHAPED BRISTLES, AND TOOTHBRUSH MANUFACTURED BY THE SAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates, in general, to methods of manufacturing toothbrushes with needle-shaped bristles and toothbrushes manufactured using the methods and, more particularly, to a method of tapering bristles set in a toothbrush and a toothbrush manufactured by the method.

2. Description of Related Art Including Information Disclosed Under 37 CFR 1.97 and 37 CFR 1.98.

In conventional methods of manufacturing toothbrushes having tapered bristles, a bundle of bristles, each having an end point from 0.16 to 0.2 mm in diameter, is cut to a predetermined length. Thereafter, the end points of the bristles are hydrolyzed by an alkali chemical or strong acid chemical, thus being tapered. Subsequently, the bristles are washed in water and dried. The bristles are thereafter folded in half and set in holes, formed in a head part of a toothbrush body, using anchors.

However, recently, toothbrushes have followed trends, so that various bristle setting patterns have been required. Furthermore, according to an increase in the size of a bundle of bristles, it has been difficult to fasten bristles with an anchor.

Three methods of manufacturing an anchorless toothbrush are as follows.

First, in a method used by Coronet Co., Ltd. of Germany, bristles are set in a mold and, thereafter, resin is injected into the mold, thus integrating the bristles with a toothbrush body.

Second, in a method used by the Oral-B company of U.S.A, bristles are set in a mold brush plate and, thereafter, the mold brush plate having bristles is placed in a mold. Subsequently, resin is injected into the mold, thus fastening the bristles to a toothbrush body.

Third, the method used by the Boucherie company of Belgium uses a bundle of bristles having a predetermined length, unlike other companies which use a spooled filament as a bristle, and bristles are set in a head insert made of plastic. Thereafter, the head insert is seated into a head insert seat formed in a head part of a toothbrush body. Subsequently, the head insert is bonded to the toothbrush body by ultrasonic waves.

The above-mentioned methods can reliably fasten bristles to a toothbrush body without anchor. However, equipment is very expensive, and productivity is relatively low. Moreover, because a mold, a bristle setting machine and an injection molding machine are integrated together, it is very difficult to change the setting pattern of bristles.

However, toothbrushes manufactured by the above-mentioned methods can realize various bristle setting patterns. Thus, the appearance is superior. As well, the bristle setting pattern can freely be designed to match the tooth structure of every type. Therefore, toothbrushes manufactured by the above-mentioned methods have been popular among consumers.

In the toothbrushes manufactured by the above-mentioned methods, to realize various bristle setting patterns, the volume of a bundle of bristles must become large. As a result, it is impossible to taper bristles using a conventional physical grinding method. It is well known that if bristles are tapered, flexibility is increased so that the gums of a user are protected from injury while brushing the teeth, and penetration ability of the bristles is increased, thus enhancing tooth brushing efficiency.

Due to these reasons, in the case of an anchorless toothbrush, instead of a method of tapering bristles, bristles made of relatively flexible nylon, for example, nylon 6, 10, and nylon 6, 12 are used, thus overcoming the above-mentioned problems. However, a nylon bristle has insufficient durability and water resistance, compared with a polyester bristle. Also, because the penetration ability of bristles, which are not tapered, is poor, tooth brushing efficiency is reduced. Furthermore, bristles made of polyester cannot be used in such a toothbrush due to excessively high stiffness.

Due to these reasons, a tapering process is required even when manufacturing toothbrushes having various setting patterns. There are bristle tapering methods as follow. First, as described above, there is a method 1) in that a bundle of bristles is cut to a predetermined length and, thereafter, the ends of the bristles are hydrolyzed by an alkali chemical or strong acid chemical, thus being tapered. Subsequently, the bristles are washed in water and dried. Thereafter, the dried bristles are folded in half and set in a toothbrush body using anchors. Second, there is a method 2) in that bristles are tapered by a physical method such as a grinding method after a bristle setting process is conducted. Third, there is a method 3) in that bristles are partially tapered by the method 1) and are then additionally machined by the method 2).

The method 2) is problematic in that, because the length of tapered portions of the bristles is relatively short, the bristles are not sufficiently flexible. On the other hand, the method 3) has the advantages of solving the problem of the method 2) and reducing the manufacturing costs. This method was proposed in Korean Patent No. 261658 which was filed by the inventor of the present invention. However, application of this method is limited to a toothbrush to be manufactured using a bundle of bristles cut to a predetermined length. That is, this method cannot be applied to the case using a spooled filament.

In addition, as proposed in Japanese Patent No. 3022762, there is a method in that, after bristles are fastened to a toothbrush body using anchors made of metal, particularly, aluminum, the bristles are immersed in an alkali chemical until just before the cores of the bristles are dissolved, thus tapering ends of the bristles.

However, this method is problematic in that, because the alkali chemical penetrates to the anchors due to a capillary phenomenon during the bristle immersion process, the anchors may be undesirably dissolved. If the anchors are dissolved, the set bristles may be removed from the toothbrush body. Furthermore, in the case of a mass production process, because hydrogen gas is generated when aluminum anchors react with alkali, there is the probability of the explosion of gas due to the heat in a reaction flask. Even if the material of the anchor is changed into brass which has been popular, dissolution may occur because zinc, added to increase the stiffness of brass, reacts with the alkali chemical.

For these reasons, a product manufactured using this method has not been commercialized. In consideration of economical efficiency, only products that are manufactured by the method, in which both ends of a bundle of bristles, cut to a predetermined length, are tapered using a chemical and thereafter folded in half and set in toothbrush bodies using anchors, has been commercialized.

Furthermore, in the case of a toothbrush manufactured by the above-mentioned method of tapering bristles using a chemical after a bristle setting process, each bristle of the toothbrush has a bottle shape, as shown in FIG. 1. Therefore, in the strict sense of word, this bristle cannot be said to be a needle-shaped bristle. Furthermore, this bristle does not have the characteristics of a needle-shaped bristle, including superior penetration ability.

The reason why the bristle is dissolved into the bottle shape, shown in FIG. 1, by a chemical is as follows. In the case that a bundle of bristles is chemically treated, because forty to fifty thousand bristles, which are densely bundled together, serve as a cooling means, the chemical is cooled while penetrating to upper portions of the bristles due to a capillary phenomenon. Therefore, the chemical cannot dissolve the upper portions of the bristles. Conversely, only the ends of the bristles which are immersed in the chemical are dissolved. However, in the case that the bristles, set in the toothbrush body, are chemically treated, because gaps between the set bristles are greater than in the case of the bundled bristles, and because the number of set bristles is less than in the case of the bundled bristles, the set bristles cannot serve as a cooling means. Therefore, the chemical, which penetrates to upper portions of the set bristles due to a capillary phenomenon, is not cooled, so that the upper portions of the bristles are also dissolved by the chemical.

Furthermore, when the bristles, which are partially tapered by the above-mentioned method, are ground by a grinder in the same manner as in method 3), because the bristles, the upper portions of which are dissolved, are inelastic, the thicknesses of the end points of the bristles become uneven. Moreover, a large number of bristles may be bent in a shape shown in FIG. 2 after being ground.

Meanwhile, recently, as proposed in Korean Patent Laid-open Publication No. 2002-0097188, a toothbrush, in which bristles are set in a mountain shape so as to enhance cleaning ability, has been commercialized. However, to dispose bristles in a mountain shape, the bristles must be cut by a cutting machine after the bristle setting process. Furthermore, it is very difficult to taper bristles of such a toothbrush using the above-mentioned conventional tapering method.

Besides, the conventional bristle tapering methods have common problems in which a bristle setting machine, to which an expensive special device is mounted, is required, and a skilled worker is necessary.

BRIEF SUMMARY OF THE INVENTION

Accordingly, the present invention has been made keeping in mind the above problems occurring in the prior art, and an object of the present invention is to provide a toothbrush which has variously shaped setting rows and tapered bristles. Another object of the present invention is to provide a toothbrush which is manufactured by a simple manufacturing process. A further object of the present invention is to provide a toothbrush which has superior water resistance and durability, and in which bristles easily penetrate into gaps between teeth.

Yet another object of the present invention is to provide a method of tapering bristles set in a toothbrush body. Still another object of the present invention is to provide a method of manufacturing a toothbrush, in which tapered bristles are set, using a typical bristle setting machine. Still another object of the present invention is to provide a toothbrush manufacturing method which is able to reduce the defective proportion. Still another object of the present invention is to provide a method of tapering bristles, which are cut in a desired shape after being set in a toothbrush body. Still another object of the present invention is to provide a toothbrush which has bristles, end points of which have even thickness.

Technical Solution

In an aspect, the present invention provides a method of manufacturing a toothbrush, including: partially tapering ends of bristles, which are made of polyester and are set in a toothbrush body, using a grinding process; and completing a bristle tapering process by immersing the partially tapered bristles in a chemical.

In another aspect, the present invention provides a method of manufacturing a toothbrush including: partially tapering ends of bristles, which are made of polyester, through a mechanical process; and completing a bristle tapering process by setting the partially tapered bristles in a toothbrush body and immersing the partially tapered bristles in a chemical.

Advantageous Effects

In the present invention, a toothbrush having tapered bristles is manufactured by a simple manufacturing process. Furthermore, the present invention solves a difficulty when tapering the set bristles in the conventional art. In addition, in the case that one-sided needle-shaped bristles are set in the toothbrush body, because a separate process of grinding shorter parts of bristles is not required, the workability is markedly enhanced. As well, the present invention is able to efficiently set needle-shaped bristles without expensive equipment.

BRIEF DESCRIPTION OF THE SEVERAL VIEWS OF THE DRAWINGS

FIG. 1 is a schematic view showing a bristle which is treated by a chemical without a partial tapering process.

FIG. 2 is another schematic view showing a bristle which is ground by a grinder after being treated by a chemical without a partial tapering process.

FIG. 3 is a side view of a conventional toothbrush in which bristles are set in a mountain shape.

FIG. 4 is a schematic view showing a one-sided needle-shaped bristle which is folded before being set in a toothbrush.

FIG. 5 is a perspective view showing a conventional head insert in which bristles are set.

FIG. 6 is a schematic view showing an enlargement of a bristle set in a toothbrush manufactured by a method according to the present invention.

DETAILED DESCRIPTION OF THE INVENTION

Hereinafter, the present invention will be described in detail with reference to the attached drawings.

In the present invention, the material of bristles of a toothbrush is a polyester, for example, polybutylene terephthalate (PBT), polyethylene terephthalate (PET), polytrimethylene terephthalate (PTT) and polypropylene terephthalate (PPT). Such polyester bristles have superior water resistance ability and durability, compared with nylon bristles. However, if polyester bristles are not tapered, the bristles are not suitable as toothbrush bristles due to the excessively high stiffness.

In a grinding process of the present invention, bristles, which are set in a toothbrush, are cut to desired lengths and are partially tapered using a finishing M/C. Here, the bristles are partially tapered such that the thickness of the end points ranges from 0.06 to 0.12 mm, preferably, from 0.08 to 0.10 mm. Furthermore, the bristles are partially tapered such that the length of the tapered portions ranges from 0.5 to 2.2 mm, and preferably from 1.0 to 2.0 mm.

Such a partial tapering process is completed by rubbing bristles with a mesh paper 220 times or more or by grinding bristles using a drum grinder for 10 to 15 seconds.

Thereafter, when the partially tapered bristles are immersed in an acid or alkali chemical, the bristles are formed in the same shape as that obtained when immersing a bundle of bristles in a chemical, but the bristles are not formed in a bottle shape as in FIG. 1. Furthermore, the thickness of end points of the bristles becomes relatively even. Here, in the case of bristles which are previously treated by the grinding process, the immersion time of bristles in a chemical is reduced by 30% or more, compared with bristles which are not treated. Furthermore, it is preferable that the bristles be tapered such that the thickness of the end points ranges from 0.01 to 0.03 mm and the length of the tapered portions ranges from 4 to 9 mm.

The method of the present invention is suitable for the manufacture of an anchorless toothbrush, but may be applied to a toothbrush having anchors. However, to apply the method to the toothbrush having anchors, the material of the anchors is changed to a material having superior chemical resistance. As several examples of material having superior chemical resistance, there are nickel, gold-plated brass and plastic.

The method of the present invention can be applied to a toothbrush having bristles which are set in a mountain shape, which is shown in FIG. 3, making it hard for bristles to be tapered using conventional techniques. In the present invention, bristles are partially tapered by a grinder and, thereafter, end portions of the bristles are immersed in a chemical in the same manner as that of conventional arts. Here, preferably, the bristles are immersed such that ends of short bristles are also immersed in a chemical. In the case of the bristles produced through the above-mentioned steps, the lengths of tapered portions of the bristles differ from each other, but the thicknesses of the end points are relatively even.

Furthermore, the method of the present invention may be applied to a toothbrush having one-sided needle-shaped bristles. A one-sided needle-shaped bristle is a bristle which has one end tapered and the other end not tapered, and is set in a toothbrush body after being folded in half. Typically, the one-sided needle-shaped bristle is set in the toothbrush body such that the tapered end is longer than the not tapered end by 2-4 mm (see, FIG. 4). The toothbrush having such one-sided needle-shaped bristles has the advantage of having both penetration ability and cleaning ability.

However, in the case of the toothbrush having one-sided needle-shaped bristles, because the portions of bristles, which are not tapered, may injure the gums of a user, it is preferable that the portions of bristles, which are not tapered, be briefly immersed in a chemical before being set in the toothbrush so that ends of the bristles are rounded.

In the present invention, normal bristles, which are not tapered, may be set in a toothbrush body such that a height difference of 2-4 mm exists between a longer part and a shorter part of each bristle. Thereafter, longer parts and shorter parts of the bristles are partially tapered using a grinder. Subsequently, if ends of the longer parts of the bristles are immersed in a chemical, the longer parts are completely tapered while the ends of the shorter parts are rounded. As such, in the present invention, the toothbrush can be manufactured through a simple process.

Furthermore, in the present invention, normal bristles having end points different in thickness may be combined together. In this case, bristles having end points different in thickness, which are combined together, are set in a toothbrush body and, thereafter, they are tapered. Then, the bristles having end points different in thickness and tapered portions different in length are combined together in the toothbrush.

In the present invention, the term 'after a bristle setting process' means both 'after bristles are set in a toothbrush body' and 'after bristles are set in a head insert (see, FIG. 5)'. In the case that bristles are set in the head insert, because the head insert is smaller than a toothbrush body, the efficiency of a process of immersing the bristles in a chemical is increased.

Several examples of methods of manufacturing toothbrushes are as follows.

EXAMPLE 1

Bristles, which have end points of 0.19 mm in thickness and are made of PBT, are set in a mold mounted to a bristle setting injection molding machine (model name: AFT CNC) which was produced by Boucherie Company of Belgium. Thereafter, portions of the bristles protruding into a cavity of the mold are thermally welded, and resin is injected into the cavity of the mold, thus manufacturing a toothbrush such that the bristles are integrated with a toothbrush body.

Subsequently, the bristles of the manufactured toothbrush are cut using a finishing machine to a desired height. Thereafter, the bristles are partially tapered by a drum grinder having protrusions such that the bristles have end points of 0.08 mm in thickness and tapered portions of 1.5 mm in length. The manufactured toothbrush is fastened to a holding jig and, thereafter, the bristles are immersed for 16 minutes into a reaction flask in which 40% sodium hydroxide solution is maintained at 120° C. Subsequently, the bristles are washed in water, neutralized and dried, thus completing the tapering process.

As a result, the thicknesses of the end points of the bristles of the toothbrush range from 0.01 to 0.02 mm. The lengths of the tapered portions of the bristles range from 5 to 8 mm (see, FIG. 6).

EXAMPLE 2

Before a tapering process of the first example, bristles are cut such that the set bristles form the mountain shape shown in FIG. 3.

These bristles of the toothbrush are tapered through the same process as that of the first example. As a result, the thicknesses of the end points of the bristles of the toothbrush range from 0.01 to 0.05 mm. The lengths of the tapered portions of the bristles range from 4 to 8 mm.

EXAMPLE 3

Bristles, which have end points of 0.19 mm in thickness and are made of PBT, are set in setting holes after being folded in half. At this time, twenty-six bristles are set in each setting hole such that a height difference of 3-4 mm exists between a longer part and a shorter part of each bristle. After the bristle setting process, the bristles are tapered such that the longer parts and the shorter parts of the bristles have end points of 0.08 mm in thickness and tapered portions of 1.5 mm in length. Thereafter, the bristles are tapered such that the longer parts of the bristles are lightly immersed in a chemical for 15 minutes. As a result, the thicknesses of the end points of the longer parts of the bristles range from 0.01 to 0.02 mm. The lengths of the tapered portions of the longer parts range from 4 to 7 mm. The thickness of the end points of the shorter parts of the bristles is maintained at 0.08 mm.

EXAMPLE 4

Normal bristles (which are not tapered), which have end points 0.203 mm thick and are made of PBT, are partially tapered using a grinder before being set in a head insert using a bristle setting machine which has a line grinder and was produced by Boucherie Company described in the first example. Thereafter, the bristles are thermally welded to the head insert. After the head insert, to which the bristles are welded, is fastened to a holding jig, the bristles are immersed for 15 minutes in a reaction flask in which 35% sodium hydroxide solution is maintained at 125° C. Subsequently, the bristles are washed in water, neutralized and dried, thus completing the tapering process. Thereafter, the head insert having the tapered bristles is seated into a head insert seat of a toothbrush body and is then bonded to the toothbrush body using ultrasonic waves, thus a toothbrush is obtained.

As a result, the thicknesses of the end points of the bristles of the toothbrush range from 0.01 to 0.02 mm. The lengths of the tapered portions of the bristles range from 5 to 8 mm.

EXAMPLE 5

Normal bristles, which have end points 0.18 mm thick and are made of PBT, are set in a circular head part of an electric toothbrush such that the heights of the bristles range from 6 to 10 mm. Thereafter, the bristles, set in the circular head part, are partially tapered using a grinder in the same manner as that of the first example. The thicknesses of the end points of the partially tapered bristles range from 0.08 to 0.1 mm. The lengths of the tapered portions are 1.5 mm.

The head part, in which the partially tapered bristles are set, is fastened to a holding jig, and the bristles are immersed for 15 minutes in a reaction flask in which 40% sodium hydroxide solution is maintained at 110° C. Subsequently, the bristles are washed in water, neutralized and dried, thus completing the tapering process.

The circular head part having the tapered bristles is coupled to a handle part of the electric toothbrush. Furthermore, the thicknesses of the end points of the bristles range from 0.03 to 0.05 mm. The lengths of the tapered portions of the bristles range from 3 to 4 mm.

EXAMPLE 6

Three kinds of bristles, which have end points of 0.152 mm, 0.178 mm and 0.203 mm in thickness and are made of PBT and polyester elastomer mixed at a weight ratio of 7:3, are set in a head insert, which is made of plastic. Here, the bristles having end points 0.152 mm thick are set in a central portion of the head insert. The bristles having end points 0.178 mm thick are set in an intermediate portion of the head part. The bristles having end points 0.203 mm thick are set in an edge portion of the head insert.

Thereafter, the bristles, set in the head insert, are partially tapered using a grinder in the same manner as that of the first example. As a result, bristles having end points from 0.07 to 0.09 mm thick, bristles having end points from 0.09 to 0.1 mm thick, and bristles having end points from 1.2 to 1.4 mm thick are combined together. The lengths of the tapered portions of the bristles range from 1.5 to 2 mm. Thereafter, the head insert having the partially tapered bristles is fastened to a holding jig, and the bristles are immersed for 17 minutes in a reaction flask in which 35% sodium hydroxide solution is maintained at 115° C. Subsequently, the bristles are washed in water, neutralized and dried. As a result, a toothbrush, in which bristles having various end points 0.01 to 0.04 mm thick and tapered portions of 3 to 6 mm in length are set, is obtained.

We claim:

1. A method of manufacturing a toothbrush comprising:

setting polyester bristles into a toothbrush body;

partially tapering end portions of the polyester bristles with a grinder having a drum with projections such that each of the polyester bristles have an end point with a thickness ranging between 0.06 to 0.12 millimeters and have the tapered end portion with a length ranging between 0.5 to 2.2 millimeters, and immersing the tapered end portions in a chemical.

2. The method of claim 1, the step of immersing comprising:

immersing the tapered end portion in the chemical such that the end points have a thickness ranging from 0.01 to 0.03 millimeters and such that the tapered end portions having a length ranging from 4 to 9 millimeters.

3. The method of claim 1, the step of setting comprising:

fastening the polyester bristles to a head part of the toothbrush by an anchor.

4. The method of claim 3, further comprising:

folding the polyester bristles so as to form a long part and a short part, said long part having a length of between 2 and 5 millimeters greater than a length of said short part.

5. The method of claim 4, the tapered end portion being on said long part, said short part having a round-shaped end.

6. The method of claim 1, the step of setting comprising:

fastening the polyester bristles to said toothbrush without an anchor.

* * * * *